US006389603B1

(12) United States Patent
Dorantes Perez

(10) Patent No.: US 6,389,603 B1
(45) Date of Patent: May 21, 2002

(54) COVERED STRUCTURE USEFUL AS A CAP

(76) Inventor: Martha Leticia Dorantes Perez, Torre Eiffel N° III Fraccionamiento "Las Torres", Salamanca, Guanajuato (MX), 36720

( * ) Notice: Subject to any disclaimer, the term of this patent is extended or adjusted under 35 U.S.C. 154(b) by 0 days.

(21) Appl. No.: 09/789,133

(22) Filed: Feb. 20, 2001

Related U.S. Application Data

(60) Provisional application No. 60/227,241, filed on Aug. 23, 2000.

(51) Int. Cl.[7] ..... A42B 1/00
(52) U.S. Cl. ..... 2/171.03
(58) Field of Search ..... 2/171.03, 171.1, 2/183, 182.8, 209.11, 209.12, 175.1, 175.4, 195.1, 195.5; 135/95, 900

(56) References Cited

U.S. PATENT DOCUMENTS

| | | | | | |
|---|---|---|---|---|---|
| 1,984,521 | A | | 12/1934 | Deegan | |
| 2,418,764 | A | | 4/1947 | Ford | |
| 4,131,954 | A | * | 1/1979 | Brock et al. | 2/177 |
| 4,148,102 | A | * | 4/1979 | Ying-Yu | 2/177 |
| 4,586,280 | A | | 5/1986 | Dane | |
| 4,760,610 | A | * | 8/1988 | Wu et al. | 2/209.1 |
| 4,832,647 | A | | 5/1989 | Perlman | |
| 5,116,288 | A | * | 5/1992 | Kondo et al. | 2/177 |
| 5,454,120 | A | | 10/1995 | Rowlands | |
| 5,495,622 | A | * | 3/1996 | Kaufman | 2/175.1 |
| 5,548,846 | A | * | 8/1996 | Bianchetti | 2/209.12 |
| 5,615,415 | A | | 4/1997 | Beckerman | |
| 5,647,064 | A | * | 7/1997 | Whittaker | 2/195.5 |
| 5,715,540 | A | | 2/1998 | Cho | |
| D401,738 | S | | 12/1998 | Scerbo | |
| 5,926,850 | A | | 7/1999 | Han | |
| 6,000,063 | A | | 12/1999 | Sullivan | |

* cited by examiner

*Primary Examiner*—John J. Calvert
*Assistant Examiner*—Katherine Moran
(74) *Attorney, Agent, or Firm*—Sherman D. Pernia

(57) ABSTRACT

The covered structure comprises a dome-shaped frame constructed using a plurality of ribs made of flexible materials and held in conformation by a flexible stay-band. A fabric crown covers the frame. A brim or visor is included to provide a covered structure useful as a cap or hat. The cap may be made adjustable to fit a range of head sizes while maintaining the shape of the crown. The structure may be covered with material which protects the wearer from the UV radiation and weather. Additionally, the overall shape of the covered structure can be made to mimic the shape of analogous larger structures and outdoor sports related equipment (specifically, tents). This latter feature of the present invention serves a promotional function enabling the covered structure to be a promotional item useful for advertising or promoting the larger structure by association.

12 Claims, 7 Drawing Sheets

FIG. 2A
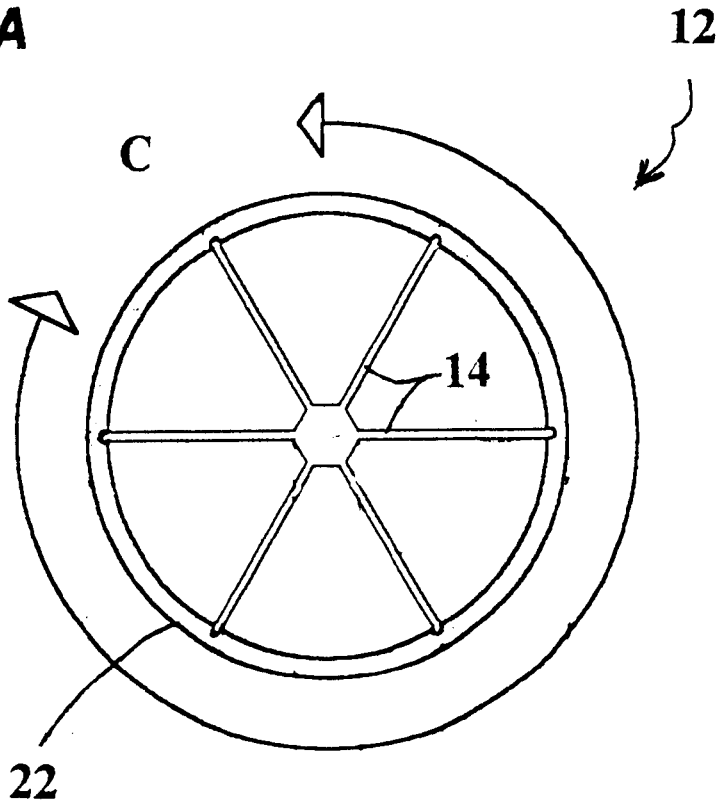
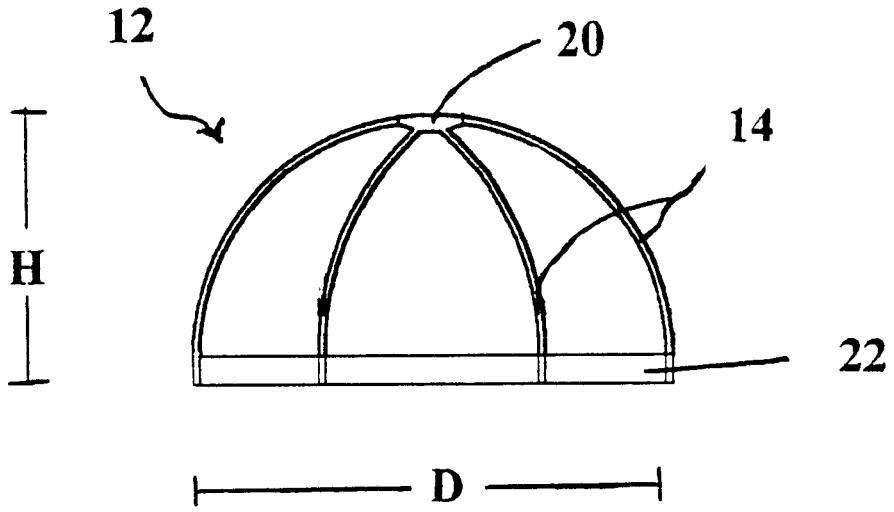
FIG. 2B

FIG. 5
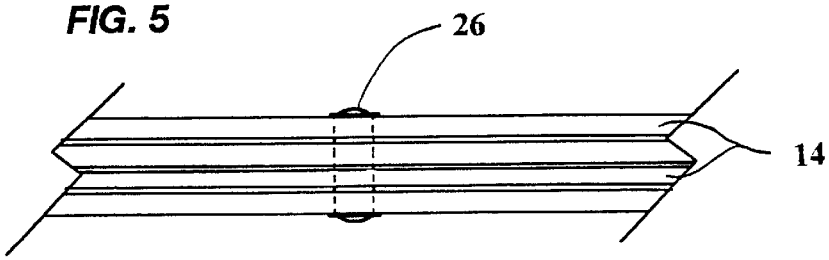
FIG. 6A
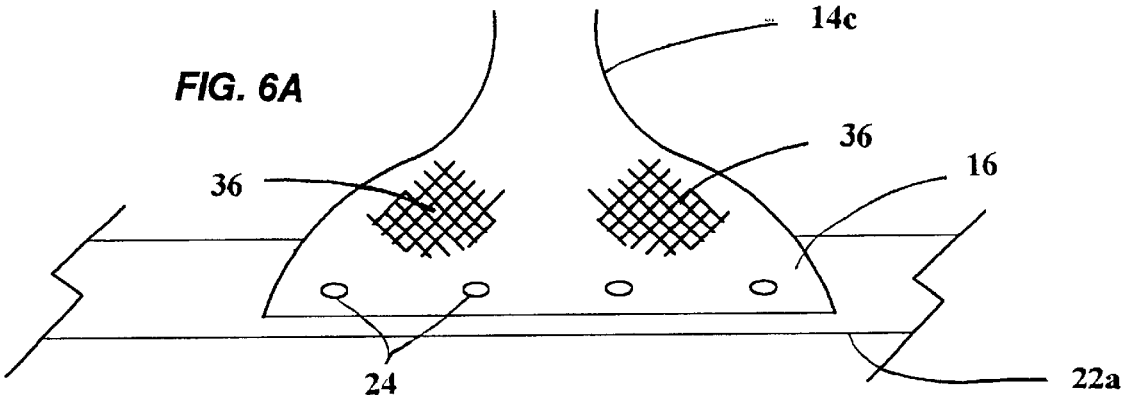
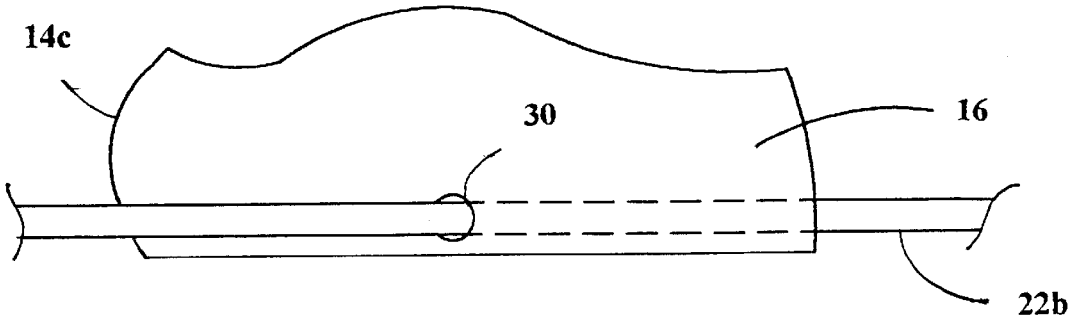
FIG. 6B

COVERED STRUCTURE USEFUL AS A CAP

The present patent application claims the benefit of prior filed U.S. Provisional Application, Ser. No. 60/227,241 filed Aug. 23, 2000, to which the present application is a regular U.S. national application.

FIELD OF THE INVENTION

The present invention is in the field of garments and other devices formed of a flexible covering over a supporting frame and worn for protection of a person from weather. More specifically, the invention relates to covered structures for use as a cap or hat and scalable for use as a tent, with the one serving as a promotional device for the other.

BACKGROUND OF THE INVENTION

Billed caps and hats, including self-adjusting caps, are not new in the art. For example, Han, U.S. Pat. No. 5,926,850 discloses a cap that can be worn by different wearers having a hat size within a predetermined range of hat sizes. An elastic sweat band attaches to the bottom edge of the crown member. As the sweat band elongates, the bottom edge of the crown member expands, permitting the cap to fit a range of head sizes. Similarly, Cho, U.S. Pat. No. 5,715,540, discloses a cap capable of being worn by wearers having a range of head sizes. A crown member is constructed with a plurality of gores, some of which are constructed with uniaxially stretchable fabric, with an elastic sweat band attached to the bottom edge of the crown member. As the sweat band elongates, the bottom edge of the crown member and the elastic gore members expand, permitting the cap to fit a range of sizes. Further, Beckerman, U.S. Pat. No. 5,615,415, also discloses a cap capable of fitting a range of head sizes. A crown member comprises triangular shaped panels attached to each other with an elastic sweat band attached to the bottom edge. A gore opposite the visor portion is constructed of an elastic material. As the sweat band elongates, the bottom edge of the crown member and the elastic gore expands, allowing the cap to fit a range of sizes.

The Deegan patent, U.S. Pat. No. 1,984,521 discloses a cap that maintains a desired shape. The flexible body portion and stay member may be bent to a desired form and be held by the bendable stay member. Alternative embodiment includes a visor, a plurality of gores stitched together, and pockets for the stays. The stays are bent to form and support the shape of the cap crown. Another cap maintaining a shape is Ford, U.S. Pat. No. 2,418,764, which discloses a cap with skeleton frames adapted to be inserted into caps made of flexible material for supporting the cap in a predetermined shape.

Caps and hats, such as baseball caps and the like, are also used in the art as novelty and promotional items. Logos and emblems, advertising and promotional messages, and other attention getting appurtenances are commonplace on billed and other types of caps and hats. For example, U.S. Pat. No. D401,738 to Scerbo and U.S. Pat. No. 5,454,120 to Rowlands both disclose the attachment of logos or other graphic displays to a baseball type billed cap. More extreme examples of promotional and attention getting appurtenances incorporated into caps and hats include: U.S. Pat. No. 6,000,063 to Sullivan disclosing a cap on which is mounted a three-dimensional model of a team insignia; U.S. Pat. No. 4,832,647 to Perlman disclosing a cap on which is mounted a pair of clapping hands that move, make noise and display a slogan; and U.S. Pat. No. 4,586,280 to Dane disclosing a novelty advertising billed cap having a simulated miniature beer tap and constantly filling beer mug mounted on the visor.

Although each of the above devices discloses features that may be useful to protect a person's head as well as serving as a platform on which an advertising or promotional item may be mounted or presented, there is still the need for alternative caps or hats that combine novel features to function both as headwear and as promotional items.

Specifically, in view of the many different products and entities that hats and caps are used to advertise and promote, it would be useful to have a cap or hat that is a promotional item advertising a covered structure such as a tent.

SUMMARY OF THE INVENTION

The covered structure of the present invention is an architectural design useful for multiple purposes, depending on the dimensions or scale of the elements and the materials used. For example, the covered structure is useful as either a tent or a cap when practiced using appropriate dimensions and materials as selectable by one of ordinary skill in the art of the desired use. However, as specifically disclosed herein, the present invention is a covered structure useful as a cap or hat. The practice of the invention for this use is accomplishable by the selection of appropriate dimensions and materials, and is described below.

The cap or hat includes a covering and framework formed of flexible materials and is worn by a person as protection from the weather and as a promotional item. The framework comprises a stay-band and a plurality of ribs constructed of a flexible material. Because the stay-band is not necessarily circular, it may have diameters of different sizes. The stay band is formed into a loop having a circumference and diameter. In addition to being flexible, the stay band may also be slightly elastic, allowing the circumference to be slightly variable. The flexibility and elasticity enables the stay-band to conform in circumference to a range of head shapes and sizes.

The ribs are also constructed of a flexible material, each rib having a length, two ends and a mid-section. The length of the ribs is greater than the diameter of the stay-band. Each rib is fixed to the stay-band at both ends, and disposed so that one end of each rib is fixed to the stay-band at a position on the circumference opposite the position where the other end of the rib is fixed to the stay band. In this configuration, the midpoints of the ribs intersect to form a dome-shaped frame. The ribs may be individually separate components, or two or more of the ribs may be integral with each other. In a preferred embodiment, all of ribs are integral with each other. To practice the present structure as a cap, three or four ribs are typically used. However, the number of ribs to be practiced in the cap is also a factor of the larger structure it is intended to mimic.

The crown is constructed of fabric, with the fabric being fitted over the frame and fixed to the stay-band. The crown is separate from the framework of the rest of the cap, and does not form part of the structure of the framework. Typically, the crown of the cap is made of a stretch fabric (e.g., LYCRA (du Pont de Nemours and Company)), spandex and other stretch fabrics) as is known in the art and commercially available. The structure's crown is a single piece, and when made of a stretch material, is stretched over the framework. The crown can be a single piece of fabric, or may be a patch-work of fabric pieces. However, the crown is not required to be made of separate gore components. Optionally, the crown may be constructed of a fabric that has properties useful for a specific purpose, such as a waterproof fabric, a UV radiation blocking or UV radiation passing fabric, or any other fabric having weather or environment protective or enhancing property.

The hat structure of the present invention has a brim attached to it proximate the stay-band. The brim may be directly or indirectly attached to the stay-band. The brim may only partially surround the circumference of the stay-band 22 in the manner of a billed hat, like a baseball cap. Optionally, the brim or bill is detachable in the manner of a visor, and also may be separately useful for that purpose.

The structure's ribs are joined or held together proximate their midpoints. The midpoints of the ribs may be joined together in a relatively fixed or permanent fashion, or may be moveable relative to each other. For example, the ribs may be integral with each other and formed from a single piece of material to provide ribs having a permanently fixed relationship. Alternatively, the ribs may be rotatable at their midpoints by means of a fastener through their midpoints to allow the ribs to be collapsible upon one another. In a further alternative, a subset of the ribs or portions of the ribs may be integrally constructed. To provide a structure wherein the configuration of the stay-band in the framework is substantially circular, the ribs are of substantially equal length. To provide a structure wherein the configuration of the stay-band in the framework is out-of-round (e.g., oval), at least one of the ribs is a different length than the others.

The covered structure of the present invention is also an architectural design useful for multiple purposes, depending on the dimensions and materials used. For example, the covered structure is useful as a tent when practiced using appropriate dimensions and materials as selectable by one of ordinary skill in the art of the desired use. The present structure is designed to incorporate openings appropriate for use as a tent, including openings for use as windows, vents, and doors. Additionally, a fabric floor may be incorporated into the covered structure when used as a tent. The floor can be practiced by having its outer perimeter edge join with the perimeter edge of the crown. The joint of the fabric of the crown with the fabric of the floor serves as the stay-band to help hold the ribs in their arcuate configuration and maintain the dome shape of the structure.

A particular benefit of the present invention is that, even though the covered structure may be practiced as different embodiments (e.g., a cap and a tent), because the different embodiments visually resemble each other, they can be made evocative each of the other. The benefit of this is that use of the covered structure as one item (e.g., the cap) can be useful in advertising the second item (e.g., the tent). Therefore, for example, the cap may be used as an advertising gimmick for the tent. Alternatively, if features of the present design are utilized in a larger structure, such as a canopy or even a pavilion, the present cap by its analogous features can elicit recognition of the larger structure, and serve as a promotional item for it.

If the present structural design is scaled up for a larger application (e.g., a tent), the structure provides space in the covering for the incorporation of openings, such as windows, vents, and doors appropriate for use in a larger structure. Additionally, a fabric floor may be incorporated into the covered structure when used as a tent. The floor can be practiced by having its outer perimeter edge join with the perimeter edge of the crown. The joint of the fabric of the crown with the fabric of the floor serves as the stay-band to help hold the ribs in their arcuate configuration and maintain the dome shape of the structure.

BRIEF DESCRIPTION OF THE DRAWINGS

FIG. 2A is a bottom view of the framework of the covered structure without the material covering.

FIG. 2B is a side view of the framework of the covered structure without the material covering.

FIG. 5 is a side view of the ribs showing the stacked and rotatable relationship of their midpoints, with a fastener through the midpoints that allows the ribs to be reversible folded together by rotation about their midpoints.

FIGS. 6A and 6B are side views of a rib attached to different embodiments of the stay-band of the present invention.

DETAILED DESCRIPTION OF THE INVENTION

Figure 1A:
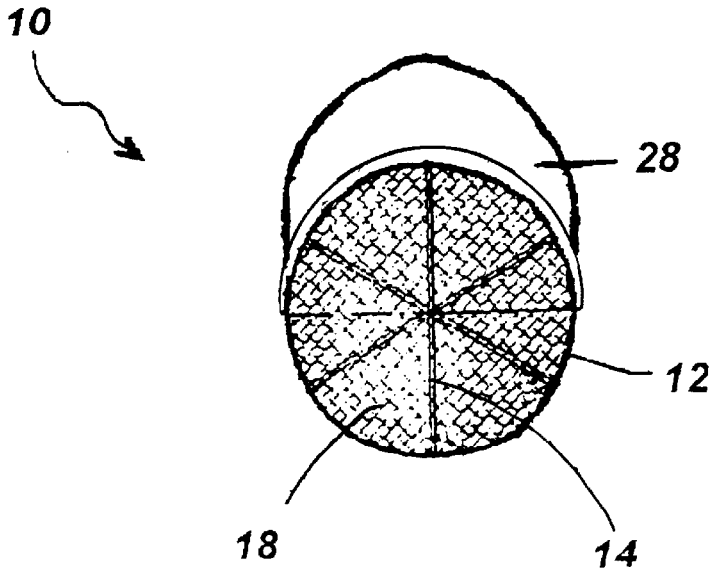
FIG. 1A is a top view of the covered structure showing visor attached to the crown with material covering.

Referring now to the drawings, the details of preferred embodiments of the present invention are graphically and schematically illustrated. Like elements in the drawings will be represented by like numbers, and similar elements will be represented by like numbers with a different lower case letter suffix.

Figure 1B:
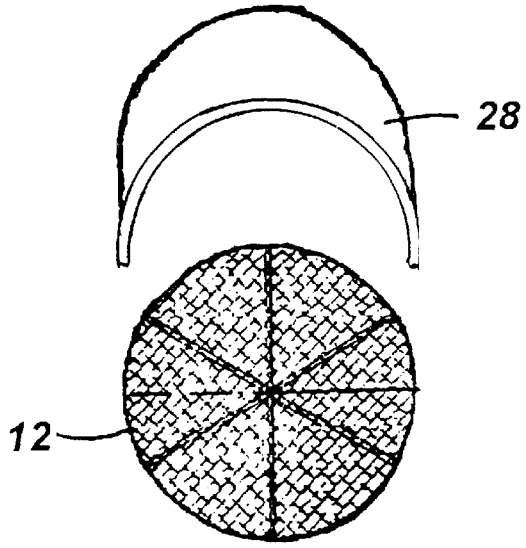
FIG. 1B is a top view of the covered structure showing the visor separated from the hat crown with material covering.

As shown in FIGS. 1A and 1B, the present invention is a covered structure 10 that is wearable as a hat or cap. The covered structure 10 when practiced as a cap can provide protection from the sun's radiation and from the weather. The covered structure 10 of the present invention is comprised of a dome-shaped frame 12 covered by a crown 18 made of fabric. Preferably, the covered structure 10 also includes a brim or visor 28, which may be removable as shown in FIG. 1B. As shown in FIGS. 2A and 2B, the dome-shaped frame 12 comprises a stay-band 22 and a plurality of flexible ribs 14.

The stay-band is constructed of a flexible material and configured in an oval or substantially circular shape as appropriate for a cap or hat. The stay-band has a circumference C and a diameter D. The flexible material of the stay-band 22 may have memory or may be without memory. Examples of flexible materials that can have memory include plastics and certain metals (e.g., spring steel). Flexible materials without memory that are useful for practice as a stay-band 22 include fabric and cordage. Whether a stay-band 22 is constructed of a material with or without memory depends on the selection of other materials that comprise the frame 12 of the covered structure 10. The result of the combination is to accomplish a substantially dome-shaped framework 22 with a height H as exemplified in FIG. 2B.

The stay-band 22 is flexible to allow the circumference C to conform to the configuration or shape of the head of the wearer. If it is desired to have the circumference C of stay-band 22 of the cap 10 fit a range of head sizes, the stay-band 22 can be made adjustable or it can be made of an elastic material. An adjustable stay-band 22 can to practiced in the present cap 10 to allow it to fit a relatively large range of head sizes. Such means for adjusting the circumference C of a hat band are known in the art and are readily adaptable by the ordinary skilled artisan for practice in the covered structure 10 of the present invention. A stay-band 22 that is elastic and stretchable may be practiced to conform the circumference C of the cap 10 to a smaller range of head sizes relative to an adjustable stay-band. Preferably, the stay-band 22 is at least slightly stretchable to adapt the circumference C of the stay-band 22 to the head size of a wearer and to improve the comfort of the fit.

Figure 3A:
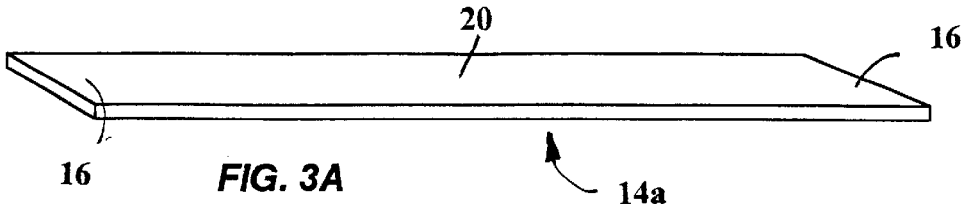
FIGS. 3A, 3B and 3C are perspective views of the various embodiments of ribs as may be practiced in the present invention.
Figure 3B:
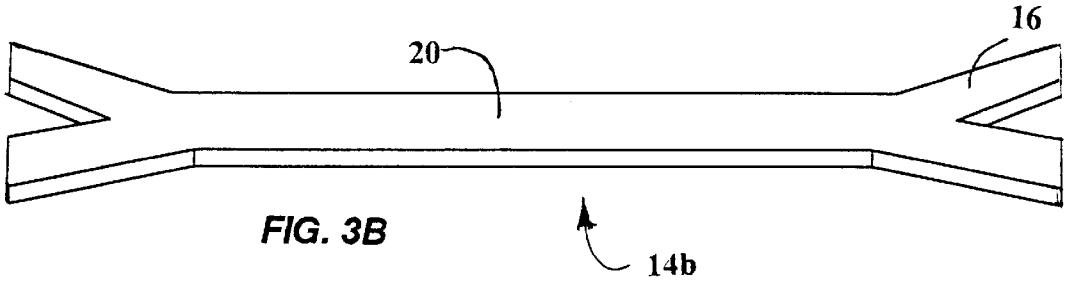
Figure 3C:
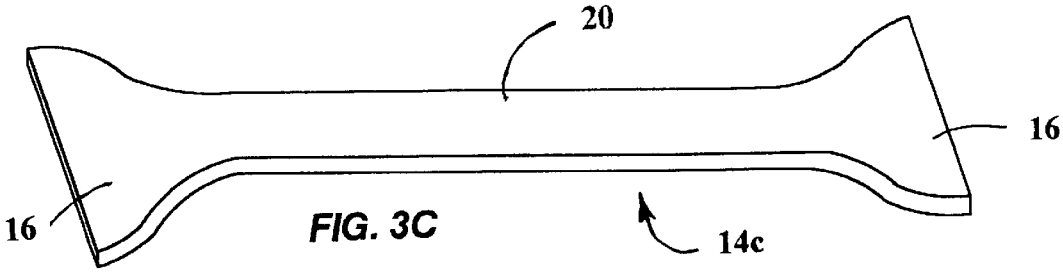
Figure 4B:
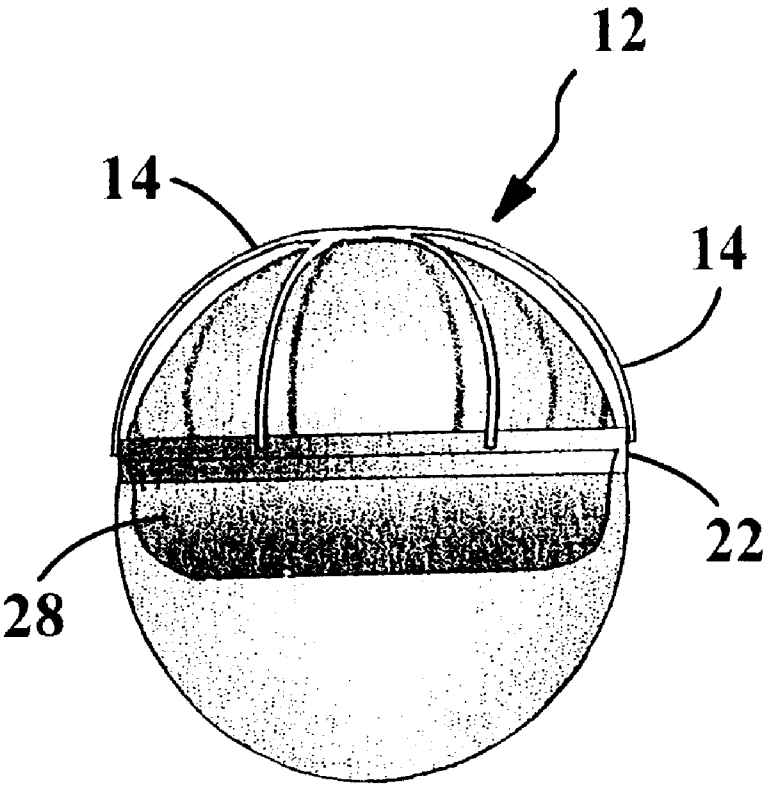
FIG. 4B is a schematic of the ribs held by the stay-band against their tendency to resume their natural shape.
Figure 4A:
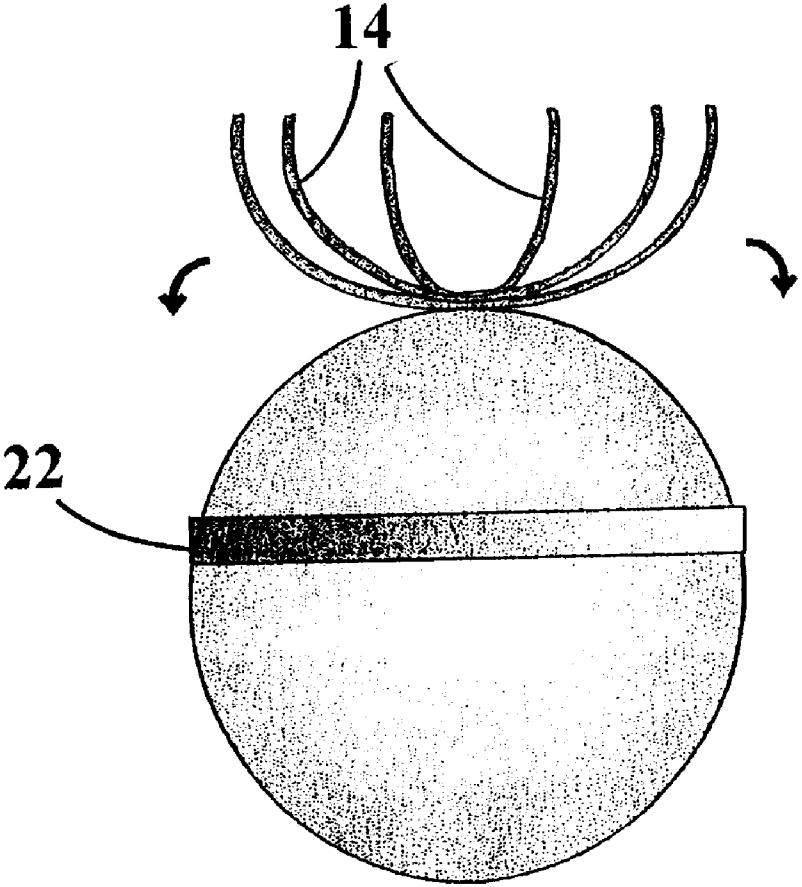
FIG. 4A is a schematic of the ribs of the present invention showing the natural tendency of the ribs to curl away from the stay-band.

As also shown in FIGS. 2A and 2B, the dome-shaped frame 12 comprises a plurality of ribs 14 constructed of a flexible material and having two ends 16, a mid-section 20 and a length L (see FIG. 3A). The length L is greater than the diameter D of the stay-band 22. The ribs 14 are constructed of a flexible material that has memory, which biases a rib to always resume its natural configuration whenever it is bent out of that configuration. In a preferred embodiment, the natural, unbiased configuration of a rib 14 is flat as shown in FIGS. 3A to 3C. Alternatively, a rib 14 may have a natural curvature giving it an arcuate configuration (see FIG. 4A). If the ribs 14 are made of a material that is highly flexible with relatively weak natural bias, they may be constructed in an arcuate configuration and disposed as shown in FIGS. 4A and 4B to form the domed framework 12 of the present invention. When the covered structure 10 is configured for use as a cap, each rib 14 is fixed relative to the stay-band 22 at both ends such that one end of each rib 14 is disposed relative to the stay-band 22 at a position on the circumference C of the stay-band 22 opposite the other end of the rib 14. The midpoints 20 of the ribs 14 intersect to form the dome-shaped frame 12 of the covered structure 10.

The midpoints 20 of the ribs are disposed in close proximity to each other so that the ribs 14 intersect at their midpoints 20. The disposition of the midpoints 20 of the ribs 14 in close proximity may be accomplished, for example, by fixing the midpoints 20 in a stacked relationship using an appropriate fastener 26 as shown in FIG. 5. Other means for disposing or fixing the midpoints 20 of the ribs 14 in close proximity are known to and readily practicable by one of ordinary skill in the art.

The height H of the peak of the dome-shaped frame 12 from the bottom of the stay-band 22 is a function of the length L of the ribs 14 used. Generally, the longer the length L of the ribs 14 the greater the height H of the frame 12. In the preferred embodiment shown in the figures, the length L of the ribs 14 are all substantially equal. However, if it is desired to provide a cap or a hat that is initially more oval, the length of at least one rib can be made different from the length of the other ribs. With one or more ribs 14 made longer or shorter than the other ribs 14, the shape of the circumference C will be less circular. Because the midpoints 20 of the ribs 14 are relatively fixed in close proximity, an asymmetry in the lengths L of the ribs 14 will cause the stay-band 22 to take a more oval configuration.

As shown in FIGS. 3A to 3C, each rib 14 has two ends 16 and a mid-section 20. Also as shown in FIGS. 3A, to 3C, the ribs 14 may be constructed in a variety of configurations. FIG. 3A shows a rib 14a of the covered structure 10 configured having a straight, slat-like shape, FIG. 3B shows a rib 14*b* which terminates in bifurcated ends 16, while FIG. 3C shows a rib 14*c* having ends 16 with a broad paddle-like shape. The selection of the type of the ribs 14 practiced with the covered structure 10 of present invention affects the configuration the crown 18 will have when the frame 12 is covered with fabric. Use of forked ribs 14*b* with bifurcated ends or paddle ribs 14*c* with broad triangular end 16 can enhance the structural integrity of the dome-shaped frame 12.

As noted above, the ribs 14 are constructed of a material and/or in a manner to have memory, meaning that when a fib 14 is bent or flexed into a configuration different from its natural shape, it has a tendency to return to the natural shape. As exemplified in FIGS. 4A and 4B, the ribs 14 are disposed in the construction of the frame 12 to resist being constrained by the stay-band 22. A benefit of having the ribs 14 exert a force contrary to the restraint of the stay-band 22 is that the dome-shaped frame 12 of the covered structure 10 resists being deformed or misshaped.

Figure 8A:
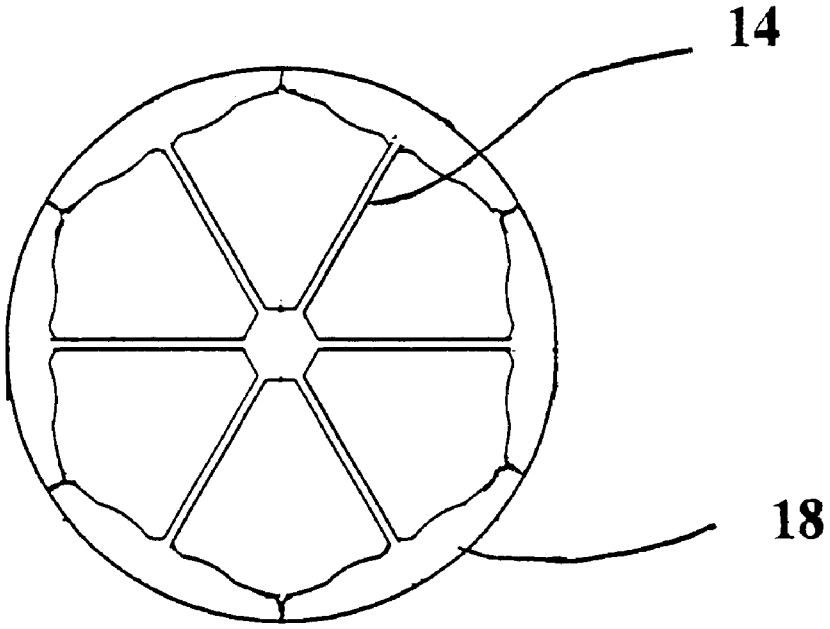
FIGS. 8A and 8B are top and side views, respectively, of the dome-shaped frame of the present invention without the fabric crown.
Figure 8B:
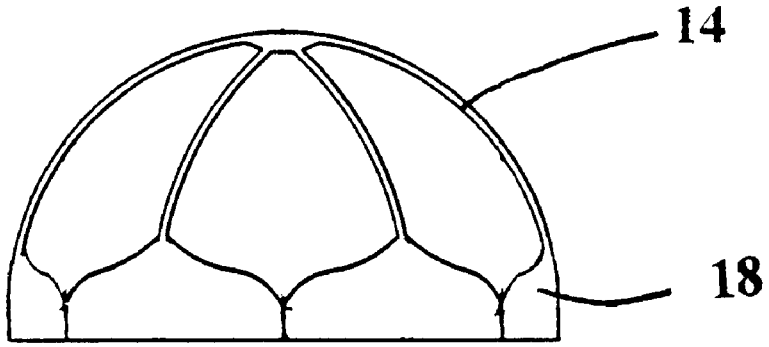

As shown in FIGS. 2A and 2B, the end 16 of each rib 14 attaches to the stay-band 22 at a position on the stay-band 22 opposite each other. The rib ends 16 may be relatively permanently fixed to the stay-band, e.g., by such means as a fastener, glue or welding. FIG. 6A shows the rib 14*c* fixed to the stay-band 22*a* by a weld 24. FIG. 6B shows the rib 14*c* attached to the stay-band 22*b* in an un-fixed manner by use of a cord type stay-band passing through an aperture 30 proximate the end 16 of the rib 14*c*. In this configuration, the position of a rib 14 relative to the stay-band may be adjusted by sliding cord-stay 22*b* through the aperture 30. Each rib 14 crosses or intersects the other ribs 14 proximate its mid-section, to form the dome-shaped frame 12 of the covered structure 10. FIG. 6A also shows a paddle-type rib 14*c* having perforations 36 through it, to provide increased ventilation of the interior of the covered structure 10 and to reduce the mass of the rib when such paddle ribs 14*c* are utilized in the practice of the present invention. Such perforations 36 also may be provided in other types of ribs 14 if desired. Additionally, FIGS. 6A and 6B show examples of how a rib end 16 is attachable to a stay-band 22. FIGS. 8A and 8B show an example of the use of paddle-type ribs 14*c* in the practice of the dome-shaped frame 12 of the present invention.

The ribs 14 are joined or held together proximate their midpoints 20. The midpoints 20 of the ribs 14 may be joined together in a relatively fixed or permanent fashion, or may be moveable relative to each other. For example, as shown in FIGS. 2A and 2B, the ribs may be integral with each other and formed from a single piece of material to provide ribs having a permanently fixed relationship. Alternatively, as shown in FIG. 5, the ribs 14 may be rotatable at their midpoints 20 by means of a fastener 26 through their midpoints 20 to allow the ribs 14 to be collapsible upon one another. In a further alternative, a subset (not shown) of the ribs 14 or portions of the ribs 14 may be unitary or integrally constructed.

As noted above, the midpoints 20 of the ribs 14 can be stacked and fixed in relationship to each other (see FIG. 5). In this stacked relationship, the ribs 14 alternatively may be rotatable relative to each other. This is useful when the covered structure is designed to be collapsible for storage or transport. When rotatable, the ribs 14 may be rotated together to be fully on top of each other for storage, and expanded again to provide the domed framework 12. Depending on the inter-relationship of the components of the covered structure 10, this may be accomplished either integrally with the structure 10, or separately after the ribs 14 are removed (as an assembly) from the structure 10. The embodiment of the relationship of the rib 14*c* and the stay-band 22*b* in FIG. 6B in part exemplifies how this may be accomplished. The end 16 of the rib 14*c* may be fixed to the stay-band 22*b* at a point between the band 22*b* and the rib end 16 (not shown) or the end 16 of the rib 14*c* may be slideable along the stay-band 22*b*. Other embodiments of this relationship are known to one of ordinary skill in the art and are readily practicable in the present invention.

As also shown in the figures, the dome-shaped frame 12 is covered by a crown 18. The crown 18 is constructed of fabric and fitted over the framework 12 and attached to the stay-band 22 to form the covering of the present covered structure 10. In the preferred embodiment, the crown 18 is made of stretchable fabric. In a preferred embodiment, the material of the crown 18 is provided as a single piece of fabric which is fitted or stretched over the dome-shaped frame 12. However, a crown 18 comprised of multiple pieces of fabric forming a single unit is also anticipated by the present invention. If necessary, the fabric of the crown 18 may include one or more seams or darts to facilitate approximating the shape of the crown 18 before being stretched over the frame 12. The crown 18 may be made of a fabric that is sun and/or weather-proof as desired. Fabric having properties such as being water-proof, UV radiation blocking, UV radiation passing, and other types of weather and environment protective characteristics are known in the art and are practicable in the present invention by the ordinary skilled artisan.

To improve its utility as a cap or hat, the covered structure 10 includes an optional brim or a visor 28 (see FIGS. 1A, 1B and FIG. 7) attached to it proximate the stay-band 22. The brim 28 may completely surround the circumference of the stay-band 22, or it may only partially surround it in the manner of a billed hat, like a baseball cap. The brim or visor 28 may be integral or fixed to the covered structure 10 or it may be removable, as shown in the figures. Typically, a brim or a visor 28 is disposed on the covered structure 10 proximate the stay-band 22. FIG. 4B shows a visor 28 fixed to the stay-band 22. Although the figures exemplify the present invention practiced with a visor 28 type brim, other types of brims are anticipated by the present invention and are practicable therein by the ordinary skilled artisan. As shown in the figures, in a preferred embodiment where the covered structure is practiced as collapsible or storable, the visor 28 (or brim) is detachable. Optionally, the detachable visor 28 may be separately useful for that purpose.

Figure 7:
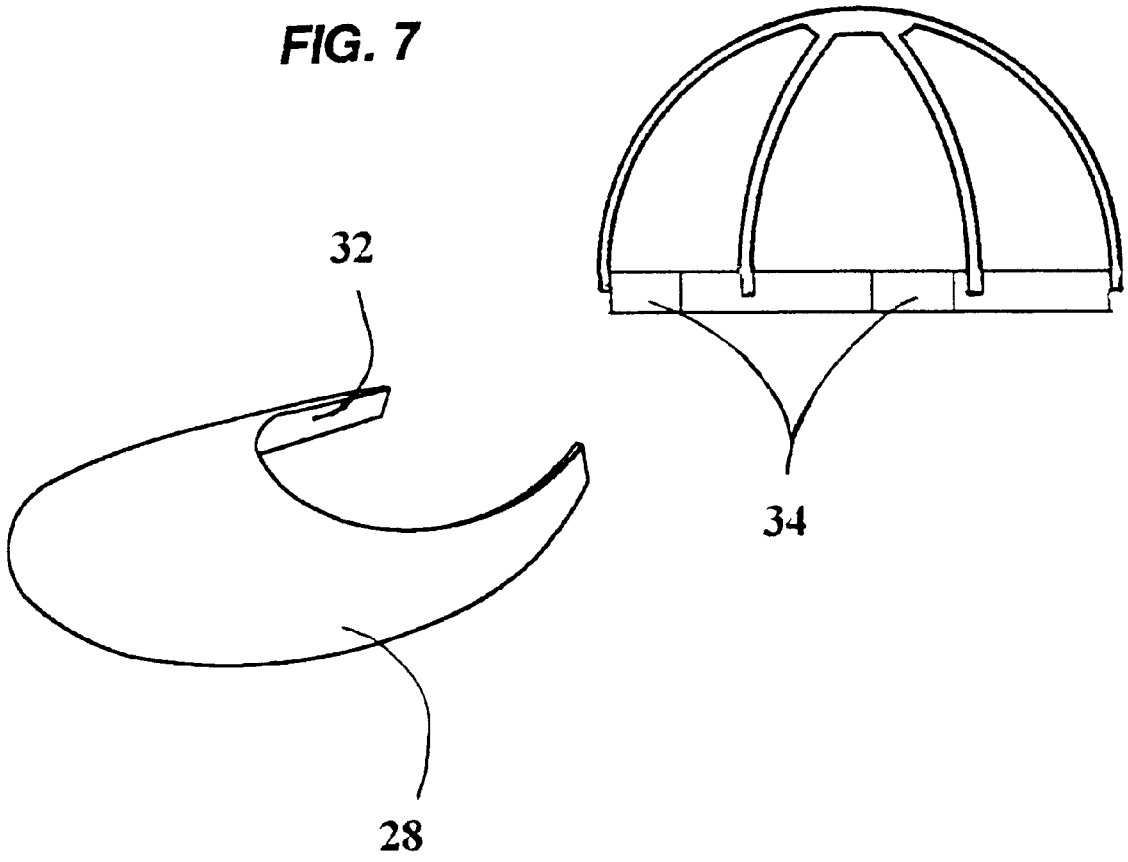
FIG. 7 is a side view of the covered structure with the visor separated from the crown.

As exemplified in FIG. 7, a visor 28 is attached to the covered structure 10 by a releaseable fastener (e.g., snaps), which in the exemplified embodiment is a hook and loop means 32 & 34 such as VELCRO or a similar material. One component of the fastener 32 is attached to the outside front and sides of the covered structure 10 proximate the stay-band 22. The other component of the fastener 34 is attached to the inside front and side of the brim/visor 28 in order to provide a means for attaching the brim/visor 28 to the covered structure 10 or for detaching the brim/visor 28 from the covered structure 10.

While the above description contains many specifics, these should not be construed as limitations on the scope of the invention, but rather as exemplifications of one or another preferred embodiment thereof. Many other variations are possible, which would be obvious to one skilled in the art. Accordingly, the scope of the invention should be determined by the scope of the appended claims and their equivalents, and not just by the embodiments.

What is claimed is:

1. A covered structure useful as a cap comprising:

a stay-band constructed of a flexible material and having a circumference and diameter;

a plurality of ribs constructed of a flexible material and having a length, two ends and a mid-section, with the length greater than the diameter of the stay-band, and each rib being fixed relative to the stay-band at both ends such that one end of each rib is disposed relative to the stay-band at a position on the circumference opposite the other end of the rib, and with the midpoints of the ribs intersecting to form, in combination with the stay-band, a dome-shaped frame; and a crown constructed of fabric, with the fabric being fitted over the frame and fixed to the stay-band to provide a covered structure useful as a cap.

2. The covered structure of claim 1, further comprising a brim attached to the stay-band.

3. The covered structure of claim 2, wherein the brim is detachable.

4. The covered structure of claim 2, wherein the brim is a visor.

5. The covered structure of claim 1, wherein the stay-band is elastic and stretchable to conform the circumference to a range of head sizes.

6. The covered structure of claim 1, wherein the ribs are fixed together proximate their midpoints.

7. The covered structure of claim 1, wherein the crown is a single piece of material stretched over the dome-shaped frame.

8. The covered structure of claim 1, wherein the fabric of the crown has a property selected from the group consisting of being: water-proof, UV radiation blocking, UV radiation passing, and any other weather or environment protective characteristics.

9. The covered structure of claim 1, wherein the ribs are rotatable at their midpoints to allow the ribs to be reversibly collapsed upon one another.

10. The covered structure of claim 1, wherein the plurality of ribs further comprises the length of at least one rib being different from the length of the other ribs.

11. The covered structure of claim 1, wherein the plurality of ribs further comprises at least two of the ribs being integral with each other.

12. The covered structure of claim 1, wherein the plurality of ribs further comprises all of the ribs being integral with each other.

* * * * *